US005950589A

United States Patent [19]

Armbruster

[11] Patent Number: 5,950,589

[45] Date of Patent: Sep. 14, 1999

[54] DISK-TYPE OIL COOLER AND METHOD OF MAKING SAME

[75] Inventor: Horst Armbruster, Illingen, Germany

[73] Assignee: Behr GmbH & Co., Stuttgart, Germany

[21] Appl. No.: 09/021,455

[22] Filed: Feb. 10, 1998

[30] Foreign Application Priority Data

Feb. 21, 1997 [DD] German Dem. Rep. ..... 197 06 893

[51] Int. Cl.[6] ..... F28F 27/02

[52] U.S. Cl. ..... 123/196 AB; 165/284; 165/916; 285/382.4

[58] Field of Search ..... 123/196 AB; 165/167, 165/284, 916; 285/222, 382.4, 382.5; 184/104.3

[56] References Cited

U.S. PATENT DOCUMENTS

| | | | |
|---|---|---|---|
| 695,614 | 3/1902 | Lape | 285/382.5 |
| 4,831,930 | 5/1989 | Nasu et al. | 123/196 A |
| 5,810,071 | 9/1998 | Pavlin | 165/916 |

FOREIGN PATENT DOCUMENTS

| | | |
|---|---|---|
| 2729202A1 | 3/1978 | Germany . |
| 4125222C2 | 2/1992 | Germany . |
| 4128153A1 | 2/1993 | Germany . |
| 19504273A1 | 8/1996 | Germany . |

*Primary Examiner*—Noah P. Kamen
*Attorney, Agent, or Firm*—Evenson, McKeown, Edwards & Kenahan, PLLC

[57] ABSTRACT

An installation of a pressure control valve provided for cold start in disk-type oil coolers is disclosed. The valve is provided with a valve housing which can be fitted directly into a connection opening between an inlet chamber and a hollow space through which the oil flows. The valve housing is utilized to accommodate a pressure spring which is arranged coaxially and acts upon the valve shutter. The valve housing is provided in the area of the connection opening with at least one desired buckling point such that, when the end of the valve housing impacts on a resistance, the wall of the valve housing will permanently deform to the outside and secure the valve in the connection opening.

19 Claims, 3 Drawing Sheets

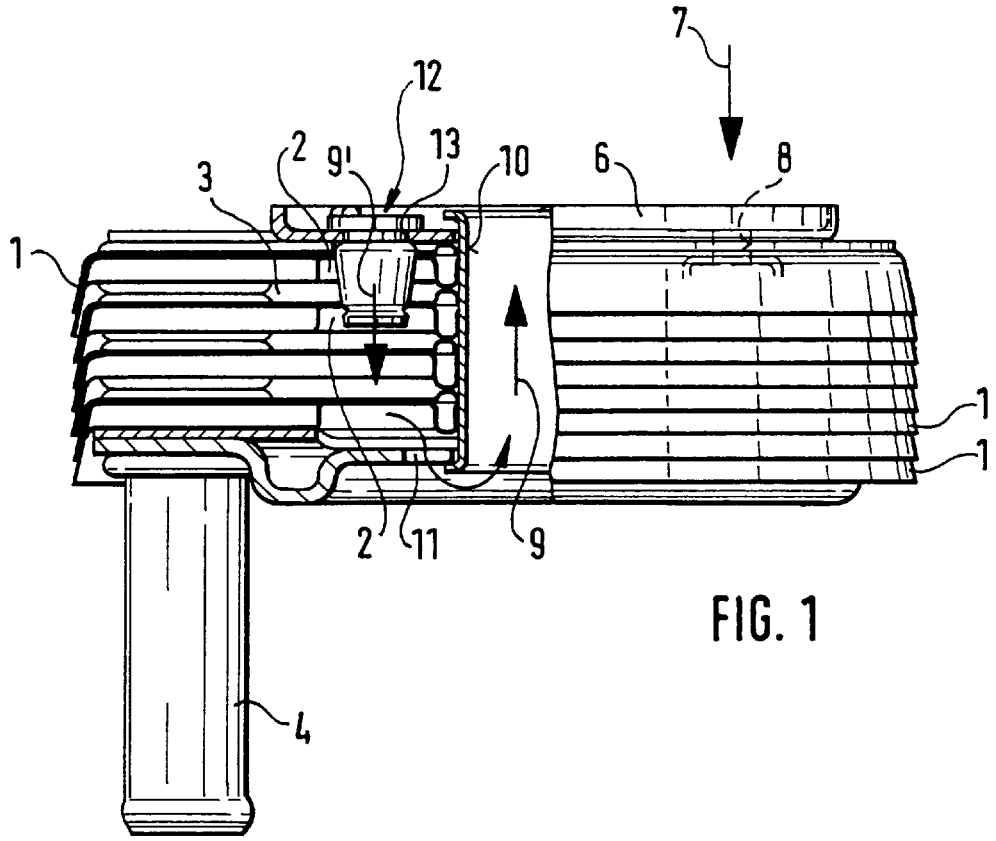
FIG. 1
FIG. 2
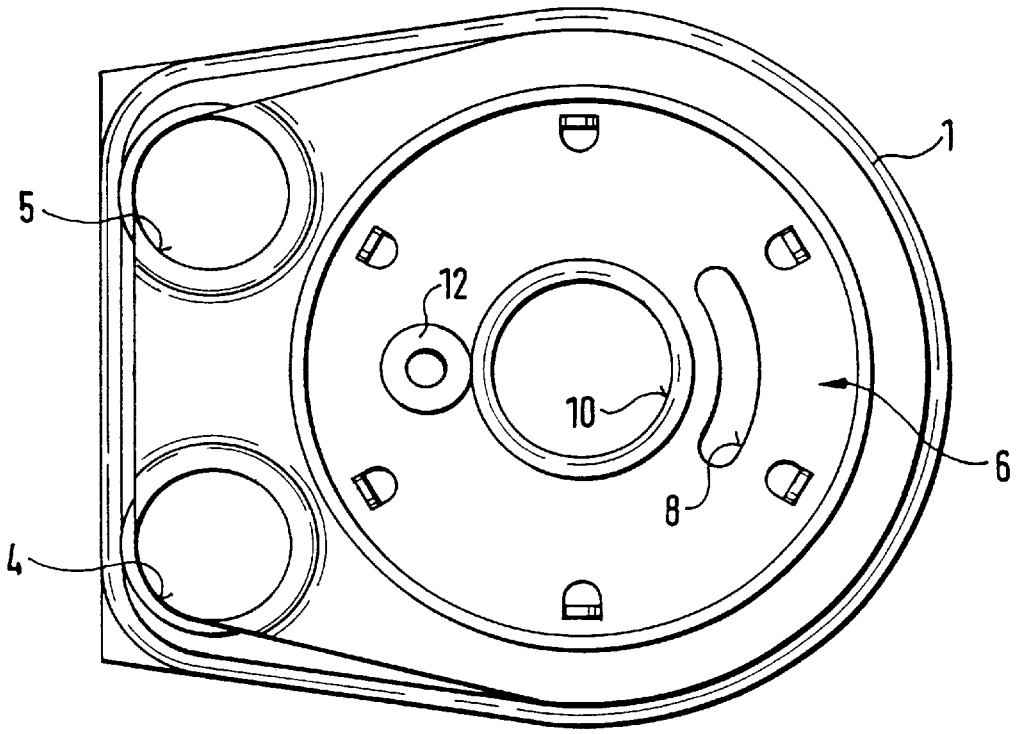

DISK-TYPE OIL COOLER AND METHOD OF MAKING SAME

BACKGROUND AND SUMMARY OF THE INVENTION

This application claims the priority of German application 197 06 893.6 filed in Germany on Feb. 21, 1997, the disclosure of which is expressly incorporated by reference herein.

The invention relates to a disk-type oil cooler for a vehicle engine having a housing with connections for feeding and removing a coolant. The housing has several hollow spaces which are arranged at spacings above one another. Each of the hollow spaces is provided with inflow openings in alignment with an inlet opening in an inlet chamber and, offset thereto, with mutually aligned outlet openings for the oil to be cooled. By way of a valve inserted into an additional connection opening between the inlet chamber and the first hollow space, a direct return flow of the oil in a cold start of the vehicle engine is permitted.

A disk-type oil cooler of this type is known from German Patent Document DE 41 28 153 C2. In this cooler, a valve was provided for a so-called cold start. When the oil is still relatively cold and viscous, it is subjected to an excessive loss of pressure if it has to be deflected through the hollow spaces of the disk-type oil cooler. This valve permits direct flow through the hollow spaces without deflection of the oil. The particular valve provided consists of a leaf spring strip which is provided, on one end, with a universal ball joint as a valve piece. By way of this universal ball joint, the valve closes off a circular opening in the front wall of the housing and of the wall of the first hollow space of the disk stack. This leaf spring strip must be used together with a base piece which requires relatively high expenditures. These high expenditures result from both the requirement for a separate installation operation and the need to maintain tolerances in order to ensure that the universal ball joint tightly closes the provided opening.

It is an object of the present invention to provide a simplified disk-type oil cooler of this type in which a significantly simpler installation of the valve which opens under the increased pressure of oil which is still cold is possible.

For achieving this object, in a disk-type oil cooler of the initially mentioned type, the valve is provided with a valve housing which can be fitted directly into the connection opening and projects into the hollow space. The valve housing receives a pressure spring which is arranged coaxially with respect to its axis and acts upon the valve shutter. In the area of the connection opening, the valve is provided with at least one wall area which buckles to the outside and which durably deforms when the end of the valve housing impacts on a resistance and rests against the edge of the connection opening.

Because of this development of the present invention, it is sufficient, for the installation of this valve, to introduce its housing into the existing connection opening and to let the end of the valve housing impact on a resistance such as, for example, a tool used for mounting. As a result of further pressure on the head of the valve, the desired buckling point will yield and at least an area of the wall of the valve housing will be permanently deformed to the outside and rest against the interior edge of the connection opening. The valve will therefore be durably mounted in a simple manner.

Various embodiments can be used for the valve. In a first embodiment and as a further development of the invention, the housing of the valve is equipped with an essentially cylindrical wall which merges into a cover provided with the valve shutter In the area of this cover, the wall is provided with a surrounding cross-sectional weakening. After insertion of the valve, this embodiment results in close contact of the cover area, in which case, in a further development of the invention, this cover can be constructed as a flange which projects to the outside beyond the wall of the valve housing. The flange can be tightly connected with the partition between the inlet chamber and a first hollow space, and preferably is coated with gum on the side facing the partition.

As a further development of the invention according to certain preferred embodiments, an inwardly projecting collar may be provided on the free end of the wall of the valve housing which faces away from the cover. The pressure spring, which is constructed as a spiral spring, is supported on the collar by one end and rests with its other end on a valve plate which forms the valve shutter together with an opening in the cover.

In another contemplated embodiment of the invention, the valve housing can be constructed as at least one U-shaped bow which is mounted, by its two legs, on a flange covering the connection opening in the inlet chamber. This bow can also be deformed correspondingly during the depression mounting. As a further development of the invention, the flange can be provided with the valve shutter and the bow can have a desired buckling point at least on one side in the area of the flange. Expediently, the bow can be provided with a desired buckling point on both sides so that, as a result, a uniform fixing and sealing of the flange occurs at the connection opening.

As a further development of the invention, the web part of the U-bow can receive one end of a spiral-shaped pressure spring having another end resting against a valve plate forming the valve shutter together with a central opening in the flange.

Other objects, advantages and novel features of the present invention will become apparent from the following detailed description of the invention when considered in conjunction with the accompanying drawings.

BRIEF DESCRIPTION OF THE DRAWINGS

FIG. 1 is a part sectional view of a disk-type oil cooler constructed according to a preferred embodiment of the invention;

FIG. 2 is a top view of the disk-type oil cooler of FIG. 1;

DETAILED DESCRIPTION OF THE DRAWINGS

Figure 3:
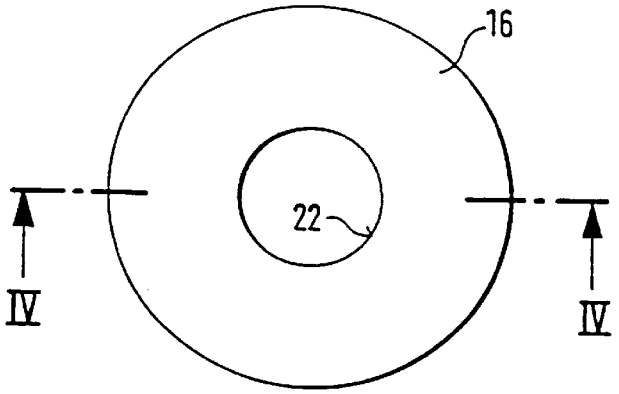
FIG. 3 is a top view of the valve inserted into the disk-type oil cooler of FIGS. 1 and 2.

FIGS. 1 and 2 illustrate a stacked oil cooler according to the invention which, in a known manner, consists of several mutually stacked shell-shaped disks or shells 1 which overlap one another on their outer edges and are sealed off there. These stacked shells 1 form hollow spaces 2 and 3, with different media flowing through mutually adjoining hollow spaces. In this case, a coolant flows through respective portions of the hollow spaces 3. This coolant is fed through the connection 4 and is removed again through the connection 5.

Figure 4:
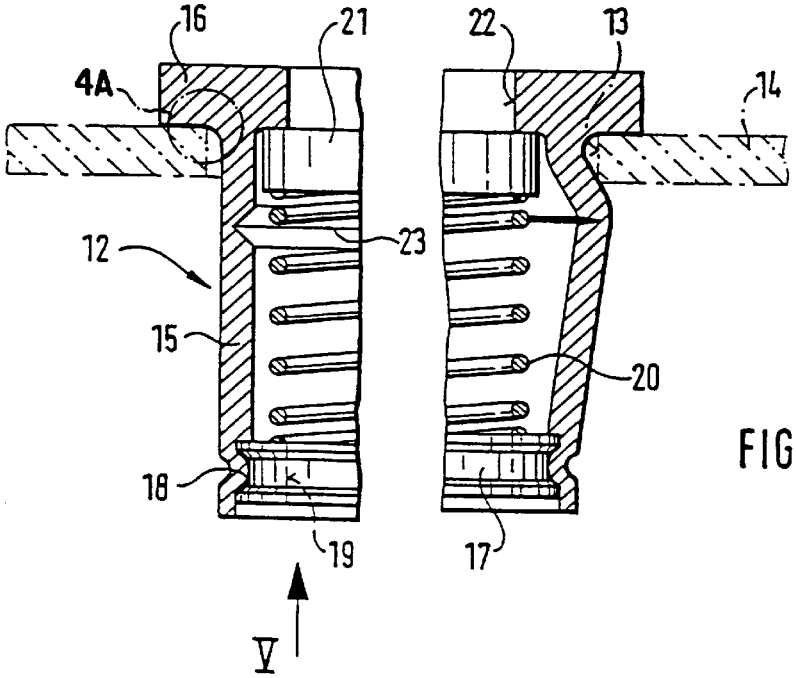
FIG. 4 is a sectional view of the valve of FIG. 3, showing, in its left half, the form of the valve before mounting of the valve and, in its right half, the form after mounting of the valve.
Figure 5:
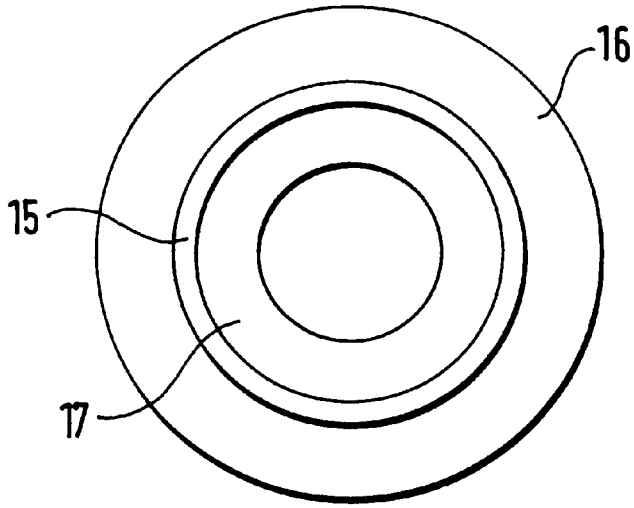
FIG. 5 is a view of the valve according to FIG. 4 in the direction of the arrow V.

In a manner which is not described in detail because it is known, the oil to be cooled is supplied to an inlet chamber 6 in the direction of the arrow 7. Oil supply takes place in a known manner, since this inlet chamber 6 is applied directly to a plane, which is not shown here, defined by the engine block or an oil filter. The oil to be cooled emerges from the inlet chamber 6 by way of an opening 8 into the uppermost hollow space 2 and flows from there to the opposite side of the cooler. The oil then flows, in the direction of the arrow 9', downward to an outlet opening 11 and from there, in turn, in a cooled condition in a known manner, through a central sleeve 10 upwards in the direction of the arrow 9 and back to the engine. A valve 12, which is shown in detail in an enlarged manner in FIGS. 3 to 5, is inserted into the inlet chamber 6. In this case, this valve 12 is situated in a connection opening 13 in a partition 14 between the inlet chamber 6 and the uppermost hollow space 2; this is also outlined in FIG. 4.

In the embodiment shown in FIG. 1, the valve 12 projects through two return flow openings of the hollow spaces 2 which are not shown in detail. When it is opened up, therefore, the valve permits the direct passage of oil present in the inlet chamber 6, by way of the opening 11, to the sleeve 10, as indicated by the arrow 9'. This event occurs particularly in the case of a cold start of the engine when the oil arriving in the chamber 6 is still cold and is therefore very viscous. The resulting higher pressure in the chamber 6 leads to the opening of the valve 12 and to the direct returning of the oil to the engine. The valve 12 closes when the oil pressure, because of the warming of the oil, has become lower. The oil then enters by way of the opening 8 into the interior of the hollow spaces 2 and, therefore, is deflected to the left (FIG. 1) in these hollow spaces, which may also be provided with turbulence inserts, and leaves the hollow spaces coaxially or approximately coaxially to the connection opening 13 or to the valve 12.

Figure 4A:
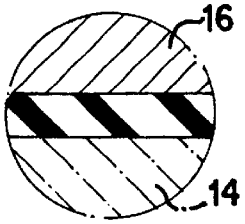
FIG. 4A is a partial enlarged sectional view showing a rubber coating on a flange of the valve.

As illustrated by FIGS. 3 to 5, this valve 12 is manufactured as a mounting part, preferably from the same material as the stacked disks 1, that is, preferably of aluminum. Specifically, as illustrated by the left half of FIG. 4, the valve is provided with an essentially cylindrical valve housing 15 which, on top, changes into a flange 16 forming a cover for the valve housing 15. On its side facing the partition 14, this flange may be coated with rubber as shown in FIG. 4A. On its lower free end, the valve housing 15 is provided with a groove-shaped recess 18 which can be created, for example, by a corresponding crimping. A ring 17 is inserted in this surrounding groove-shaped channel 18 and, on this ring 17, a lower end of a spiral-shaped pressure spring is supported. The upper end of this spiral-shaped pressure spring rests against a valve plate 21 which, together with the opening 22 in the flange 16, forms a valve shutter. When this valve shutter is opened up, the space inside the valve housing 15 will be open in the downward direction. The clear width 19 of the ring 17 expediently corresponds to the diameter of the opening 22. The valve plate 21 is not shown in FIG. 5.

The interior wall of the valve housing 15 is provided with a surrounding groove 23 which therefore forms a desired buckling point on the interior side of the stem wall.

The right half of FIG. 4 shows that the wall of the valve housing 15 is buckled toward the outside during the mounting of the valve 12. This is achieved when the valve is inserted and the lower end of the wall of the valve housing 15 strikes a resistance, for example, a counterface which is provided by a tool, which is not shown. The wall, therefore, is upset and, as a result, as illustrated in the right half of FIG. 4, buckles to the outside. This buckled-out wall is placed on the edge of the opening 13 in the partition 14 and, in this manner, fixes the flange 16 and therefore the valve 12 on this partition 14. This upsetting operation is achieved by pressing the valve into an already completely soldered disk-type oil cooler.

Figure 6:
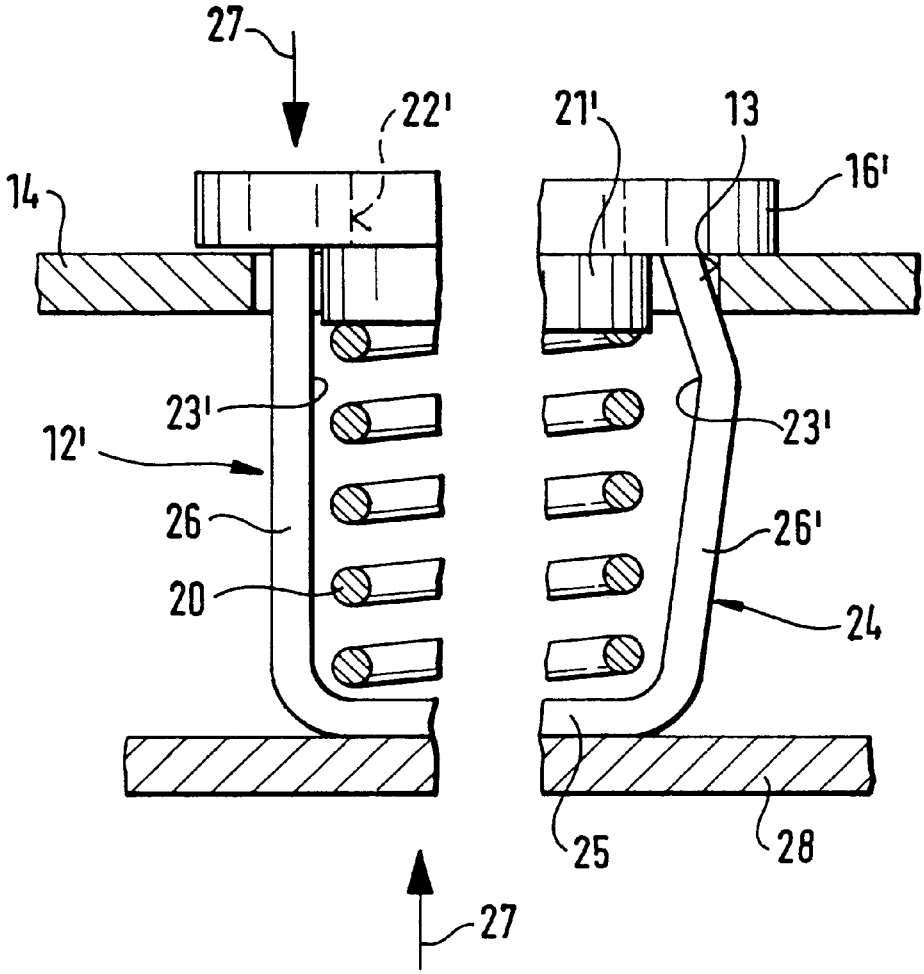
FIG. 6 is a representation similar to FIG. 4 of another embodiment of a valve according to the present invention.

FIG. 6 shows a modified valve 12' provided with a U-shaped bow 24 instead of a cylindrical stem. Two legs of the bow are connected with the flange 16'. The lower end of the spiralshaped pressure spring 20 rests against the lower cross web 25 of the bow 24. The upper end of the pressure spring 20, in turn, presses onto the valve plate 21' which, together with the opening 22', forms the valve shutter. A buckling-out of the leg 26 into the position 26' is achieved by the arrangement of a desired buckling point analogously to the embodiment of FIG. 4. The buckling-out is achieved when, during insertion of the valve 12' in the position illustrated in the left half of FIG. 6, pressure is exercised on the bow in the directions of the arrows 27 pointing toward one another. This can take place by contact with a counterface forming part of a tool, not shown here in detail, which is indicated with the reference number 28. The tool may, for example, be guided from below through the opening 13 by way of a shaft. As the result of such a force, the leg 26 buckles out into a position 26' (FIG. 6, right) and, by means of its upper area 23', is placed against the bottom side of the partition 14 in the area of the opening 13. This embodiment can also be easily manufactured and mounted. Since the diametrically opposite legs rest against the partition 14, this embodiment can also ensure good fixing of the flange 16' on the partition 14; fixing occurs because of the remaining deformation of the legs 26 in the manner illustrated on the right side of FIG. 6. In this embodiment, the flange 16' may also be coated with rubber on its side facing the partition 14. Therefore, the valve is also situated tightly on the partition 14. However, as is also illustrated in FIG. 4, when there is circular contact of the walls of the stem, in the manner of a rivet, a very firm fixing of the flange 16 results.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Disk-type oil cooler for a vehicle engine comprising:

a housing with connections for feeding and removal of a coolant and having several hollow spaces which are arranged at a distance above one another, each of said hollow spaces being provided with inflow openings and with outlet openings for oil to be cooled, a valve inserted into an additional connection opening, between inlet chamber and an uppermost hollow space, to permit a direct return flow of the oil during a cold start of the vehicle engine, a valve housing which is directly inserted into the connection opening and projects into the uppermost hollow space, and a pressure spring which is accommodated in said valve housing, is arranged coaxially with an axis of said valve housing, and acts upon a valve shutter of the valve, the valve housing being provided with at least one predetermined buckling point in an area of the valve housing near the connection opening, said buckling point permitting outward deformation of a wall area of the valve housing so that it is placed against an edge of the connection opening when an end of the valve housing strikes against a resistance.

2. Disk-type oil cooler according to claim 1, wherein the valve housing includes an essentially cylindrical wall which merges into a flange and, below this flange, is provided with a surrounding cross-sectional weakening defining said buckling point.

3. Disk-type oil cooler according to claim 2, wherein the cross-sectional weakening is a groove extending around an interior side of the wall area of the valve housing.

4. Disk-type oil cooler according to claim 2, wherein the flange projects radially beyond the wall of the valve housing and is tightly connected with a partition between an inlet chamber and the uppermost hollow space.

5. Disk-type oil cooler according to claim 4, wherein the flange (16) is coated with rubber on its side facing the partition (14).

6. Disk-type oil cooler according to claim 2, and further comprising an inwardly projecting collar provided at a free end of the wall of the valve housing facing away from the flange, the pressure spring being constructed as a spiral spring and supported at one end by said collar.

7. Disk-type oil cooler according to claim 6, wherein the pressure spring has its other end resting against a valve plate which, together with an opening in the flange, forms the valve shutter.

8. Disk-type oil cooler according to claim 6, wherein the inwardly projecting collar is formed by a ring inserted into an interior wall surface of the valve housing.

9. Disk-type oil cooler according to claim 1, wherein the U-shaped bow has two legs by which the bow is mounted on a flange which covers the additional connection opening.

10. Disk-type oil cooler according to claim 9, wherein the bow has a desired buckling point at least on one side near the connection opening.

11. Disk-type oil cooler according to claim 9, wherein a lower cross web of the U-shaped bow accommodates one end of said pressure spring.

12. Disk-type oil cooler according to claim 11, and further comprising a valve plate, wherein the other end of the pressure spring rests against said valve plate which, together with a central opening in the flange, forms the valve shutter.

13. A valve assembly for a disk-type oil cooler for a vehicle engine having a cooler housing with a connection opening, comprising:

a valve housing insertable into the connection opening to project into a hollow space, and a pressure spring arranged coaxially with the valve housing to act upon a valve shutter, said valve housing being provided with at least one predetermined weakened buckling point which permits radial deformation of a wall area of the valve housing in response to axial forces on said valve housing to fix the valve housing in an in use assembled position against an edge of the connection opening.

14. A valve assembly according to claim 13, wherein the valve housing includes an essentially cylindrical wall which merges into a flange and, below this flange, is provided with a surrounding cross-sectional weakening defining said buckling point.

15. A valve assembly according to claim 14, wherein the cross-sectional weakening is a groove extending around an interior side of the wall area of the valve housing.

16. A method of making a disk-type oil cooler for a vehicle engine, comprising the steps of:

providing a cooler housing with coolant feeding and removal connections and having a plurality of hollow spaces arranged above one another, and providing a valve controlling oil flow in said cooler as a function of engine operating conditions, said valve comprising:

a valve housing which is inserted into a housing connection opening so as to project into an uppermost hollow space of said hollow spaces, and a pressure spring arranged coaxially with the valve housing so as to act upon a valve shutter, said valve housing being provided with at least one predetermined buckling point which permits radial deformation of a wall area of the valve housing in response to axial forces on said valve housing to fix the valve housing in an in use assembled position against an edge of the connection opening.

17. A method according to claim 16, wherein the valve housing includes an essentially cylindrical wall which merges into a flange and, below this flange, is provided with a surrounding cross-sectional weakening defining said buckling point.

18. A method according to claim 17, wherein the cross-sectional weakening is groove extending around an interior side of the wall area of the valve housing.

19. Disk-type oil cooler for a vehicle engine comprising:

a housing with connections for feeding and removal of a coolant and having several hollow spaces which are arranged at a distance above one another, each of said hollow spaces being provided with inflow openings and with outlet openings for oil to be cooled, a valve inserted into an additional connection opening, between an inlet chamber and an uppermost hollow space, to permit a direct return flow of the oil during a cold start of the vehicle engine, a U-shaped bow which is directly inserted into the connection opening and projects into the uppermost hollow space, and a pressure spring which is accommodated in said U-shaped bow, is arranged coaxially with an axis of said additional connection opening, and acts upon a valve shutter of the valve, the U-shaped bow being provided with at least one redetermined buckling point in an area of the valve housing near the connection opening, said buckling point permitting outward deformation of an upper area of the U-shaped bow so that it is placed against an edge of the connection opening when an end of the U-shaped bow strikes against a resistance.

* * * * *